US010201242B2

(12) United States Patent
Peska

(10) Patent No.: US 10,201,242 B2
(45) Date of Patent: Feb. 12, 2019

(54) GARMENT STRETCHER

(71) Applicant: Ben Peska, Katy, TX (US)

(72) Inventor: Ben Peska, Katy, TX (US)

( * ) Notice: Subject to any disclaimer, the term of this patent is extended or adjusted under 35 U.S.C. 154(b) by 0 days.

(21) Appl. No.: 15/394,934

(22) Filed: Dec. 30, 2016

(65) Prior Publication Data

US 2017/0188733 A1 Jul. 6, 2017

Related U.S. Application Data

(60) Provisional application No. 62/272,694, filed on Dec. 30, 2015.

(51) Int. Cl.
*A47G 25/68* (2006.01)
*A47G 25/62* (2006.01)

(52) U.S. Cl.
CPC ..... *A47G 25/68* (2013.01); *A47G 25/62* (2013.01)

(58) Field of Classification Search
CPC .... A47G 25/62; A47G 25/621; A47G 25/622; A47G 25/623; A47G 25/626; A47G 25/627; A47G 25/628; A47G 25/629; A47G 25/68
See application file for complete search history.

(56) References Cited

U.S. PATENT DOCUMENTS 82,666 A * 9/1868 Wells
1,062,403 A * 5/1913 Kahn ..... A41F 17/00 16/DIG. 8
2,177,497 A * 10/1939 Nash ..... B65D 73/0021 248/317
D175,169 S 7/1955 Jacobson
2,805,010 A * 9/1957 Brookhart ..... A47G 25/62 223/72
2,922,209 A 1/1960 Longhi
3,107,361 A * 10/1963 Glutting, Sr. ..... A47K 3/38 160/349.1
3,131,449 A 5/1964 Iida
5,305,484 A * 4/1994 Fitzpatrick ..... D06F 73/02 223/70
5,427,230 A * 6/1995 Mattox ..... A45C 11/16 206/478
8,393,015 B2 3/2013 Jones
2007/0295769 A1 12/2007 Burroughs
2010/0282785 A1 * 11/2010 Roselle ..... A47G 25/32 223/61

OTHER PUBLICATIONS

James Vaughn Wrinkle Removal System U.S. Appl. No. 15/347,510, filed Nov. 9, 2016.

* cited by examiner

*Primary Examiner* — Ismael Izaguirre
(74) *Attorney, Agent, or Firm* — Global Intellectual Property Agency, LLC; Daniel Boudwin

(57) ABSTRACT

A garment stretcher. The garment stretcher includes an elongated weight having a first end, a second end, and a midpoint. A first clip is connected to the first end of the elongated weight, a second clip is connected to the second end of the elongated weight, and a third clip is connected to the third end of the elongated weight. Each of the clips is removably securable to a garment such as a shirt. When the elongated weight is secured to the lower end of a hanging garment, the elongated weight exerts a downward force on the garment and causes it to stretch and lengthen over time. The even spacing of the clips ensures that the shirt is stretched in a uniform manner.

8 Claims, 2 Drawing Sheets

GARMENT STRETCHER

CROSS REFERENCE TO RELATED APPLICATIONS

This application claims the benefit of U.S. Provisional Application No. 62/272,694 filed on Dec. 30, 2015. The above identified patent application is herein incorporated by reference in its entirety to provide continuity of disclosure.

FIELD OF THE INVENTION

The present invention relates to garment stretching devices. More specifically, the present invention provides a garment stretcher having an elongated weight removably securable to a garment in order to stretch or lengthen the garment.

BACKGROUND OF THE INVENTION

Washing and drying a garment such as a shirt, pants, or the like can damage the structural integrity of the garment over time. Garments can shrink in the dryer such that they no longer fit an individual. Further, individuals who grow or gain weight may be unable to wear clothes that once fit them, leaving a closet full of unworn garments. It can be exceedingly expensive to replace clothing that has shrunk or otherwise no longer fits. It is therefore desirable to provide a garment stretcher that can be removably secured to a garment in order to stretch or lengthen the garment n a uniform manner.

Devices have been disclosed in the known art relating to garment stretching devices. These include devices that have been patented and published in patent application publications. These devices generally relate to wrinkle removal devices and garment stretching devices, such as U.S. Pat. No. 8,393,015, U.S. Patent Application Publication Number 2007/0295769, U.S. Pat. No. 2,922,209, U.S. Pat. No. 3,131,449, and U.S. Pat. No. D175,169.

The devices in the known art have several drawbacks. Most of these devices are used to remove wrinkles and do not provide enough downward force to lengthen a garment. Further, the devices in the known art do not spread the force exerted by the weight across the width of the garment, which is important in order to ensure even stretching and lengthening of the garment.

In light of the devices disclosed in the known art, it is submitted that the present invention substantially diverges in design elements from the prior art and consequently it is clear that there is a need in the art for an improvement to existing garment stretching devices. In this regard the present invention substantially fulfills these needs.

SUMMARY OF THE INVENTION

In view of the foregoing disadvantages inherent in the known types of garment stretchers now present in the prior art, the present invention provides a garment stretcher wherein the same can be utilized for providing convenience for the user when stretching and elongated the length of a garment. The garment stretcher includes an elongated weight having a first end, a second end, and a midpoint, wherein the midpoint is equidistant from the first end and the second end. A first clip is disposed on the first end of the elongated weight, a second clip is disposed on the second end of the elongated weight, and a third clip is disposed on the midpoint of the elongated weight. Each of the first clip, second clip, and third clip is removably securable to a garment.

One object of the present invention is to provide a garment stretcher having an elongated weight that is securable to the lower end of a garment in order to stretch and lengthen the garment over time.

Another object of the present invention is to provide a garment stretcher that evenly spreads the force of a weight across the width of a garment in order to evenly stretch or lengthen the garment in a uniform manner.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
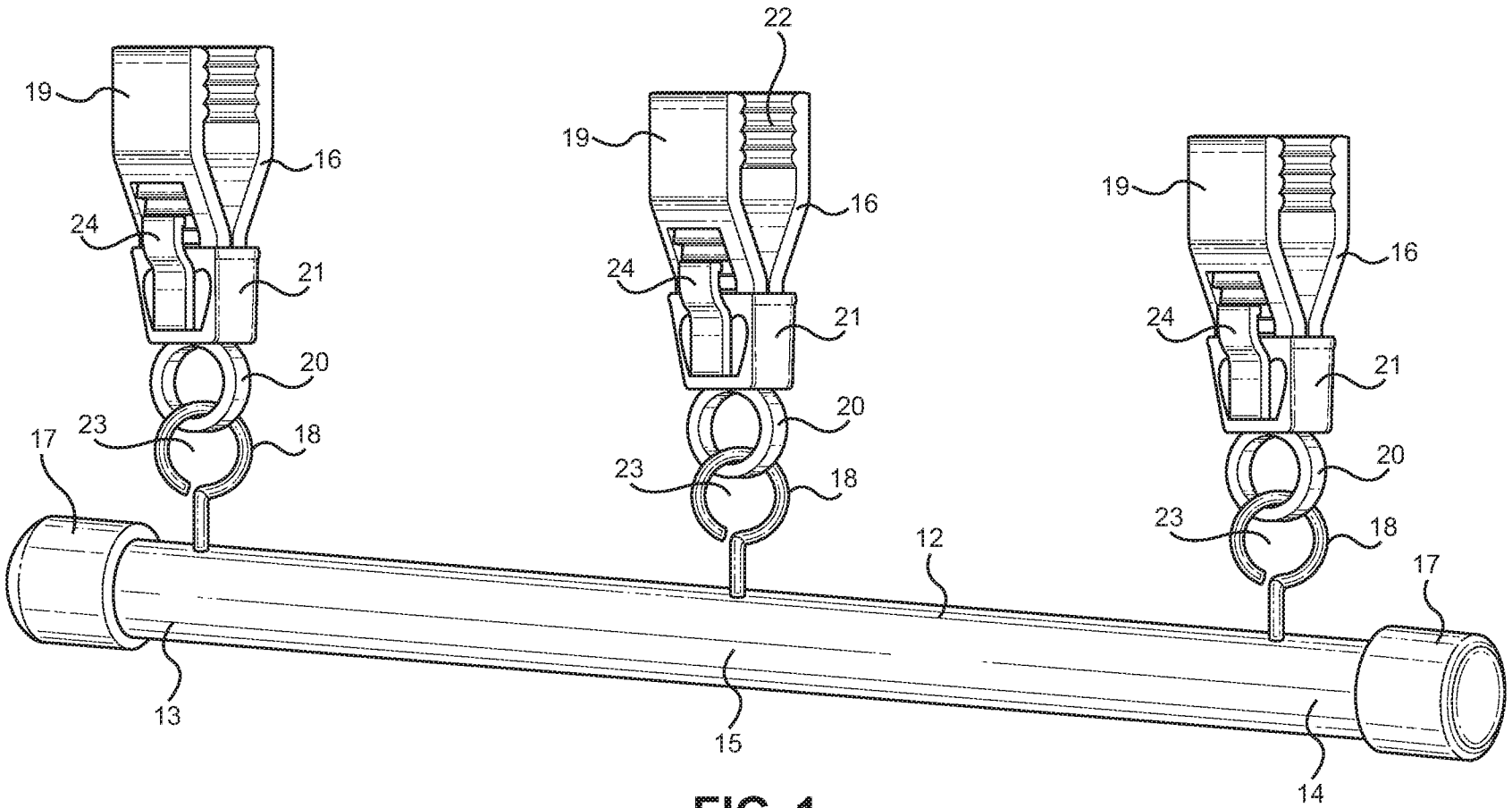
FIG. 1 shows a perspective view of a garment stretcher according to the present invention.

Reference is made herein to the attached drawings. Like reference numerals are used throughout the drawings to depict like or similar elements of the garment stretcher. For the purposes of presenting a brief and clear description of the present invention, the preferred embodiment will be discussed as used for increasing the length of a garment. The figures are intended for representative purposes only and should not be considered to be limiting in any respect.

Referring now to FIG. 1, there is shown a perspective view of a garment stretcher according to the present invention. The garment stretcher generally comprises an elongated weight 12 having a first end 13, a second end 14, and a midpoint 15 that is equidistant from the first end 13 and the second end 14. The elongated weight 12 provides a downward force in order to stretch a garment when the garment stretcher is secured thereto. The elongated weight 12 may be composed of metal, rubber, or any other suitably heavy material. In alternate embodiments, the elongated weight 12 may be hollow and filled with a substance such as sand for providing the necessary mass to stretch a garment. The elongated weight 12 further comprises end caps 17 disposed on the first end 13 and the second end 14 thereof. The end caps 17 may be removably secured to the first and second ends 13, 14 via a friction fit or a threaded connection therewith. The end caps 17 prevent the elongated weight 12 from damaging other items when secured to a garment that is hung in a closet alongside other garments.

A plurality of clips 16 are disposed on the elongated weight 12. The clips 16 are configured to removably secure the garment stretcher to a garment. In the illustrated embodiment, the clips comprise a pair of jaws 19 having ridges 22 thereon for securely gripping a garment, and a slide 21 with locking mechanism 24 that maintains the clip 16 in a closed position. In this way, the pair of jaws 19 of each clip 16 are adapted to tighten each clip 16 against a piece of fabric in order to removably secure the elongated weight 12 thereto. In the illustrated embodiment, three clips 16 are utilized, wherein a first clip 16 is disposed on the first end 13 of the elongated weight 12, a second clip 16 is disposed on the second end 14 of the elongated weight 12, and a third clip 16 is disposed on the midpoint 15 of the elongated weight 12. This arrangement of the clips 16 allow for the weight of the elongated weight 12 to be evenly distributed and stretch a garment in a uniform manner.

In the shown embodiment, the elongated weight 12 further comprises three eyelets 18, wherein one eyelet 18 is disposed on each of the first end 13, second end 14, and midpoint 15 of the elongated weight 12. The clips 16 further comprise loops 20 on a lower end thereof. The loop 20 of each clip 16 engages the opening 23 of its respective eyelet 18. The connection of the loop 20 and eyelet 18 allows the loop 20 to be freely rotatable about the eyelet 18, which in turn allows for movement of the elongated weight 12 with respect to the clips 16. This allows the elongated weight 12 to hang freely in an optimal position when secured to a garment. Additionally, each eyelet 18 is oriented in the same direction as one another, which further ensures that each connection between elongated weight 12 and the clip 16 is uniform.

Figure 2:
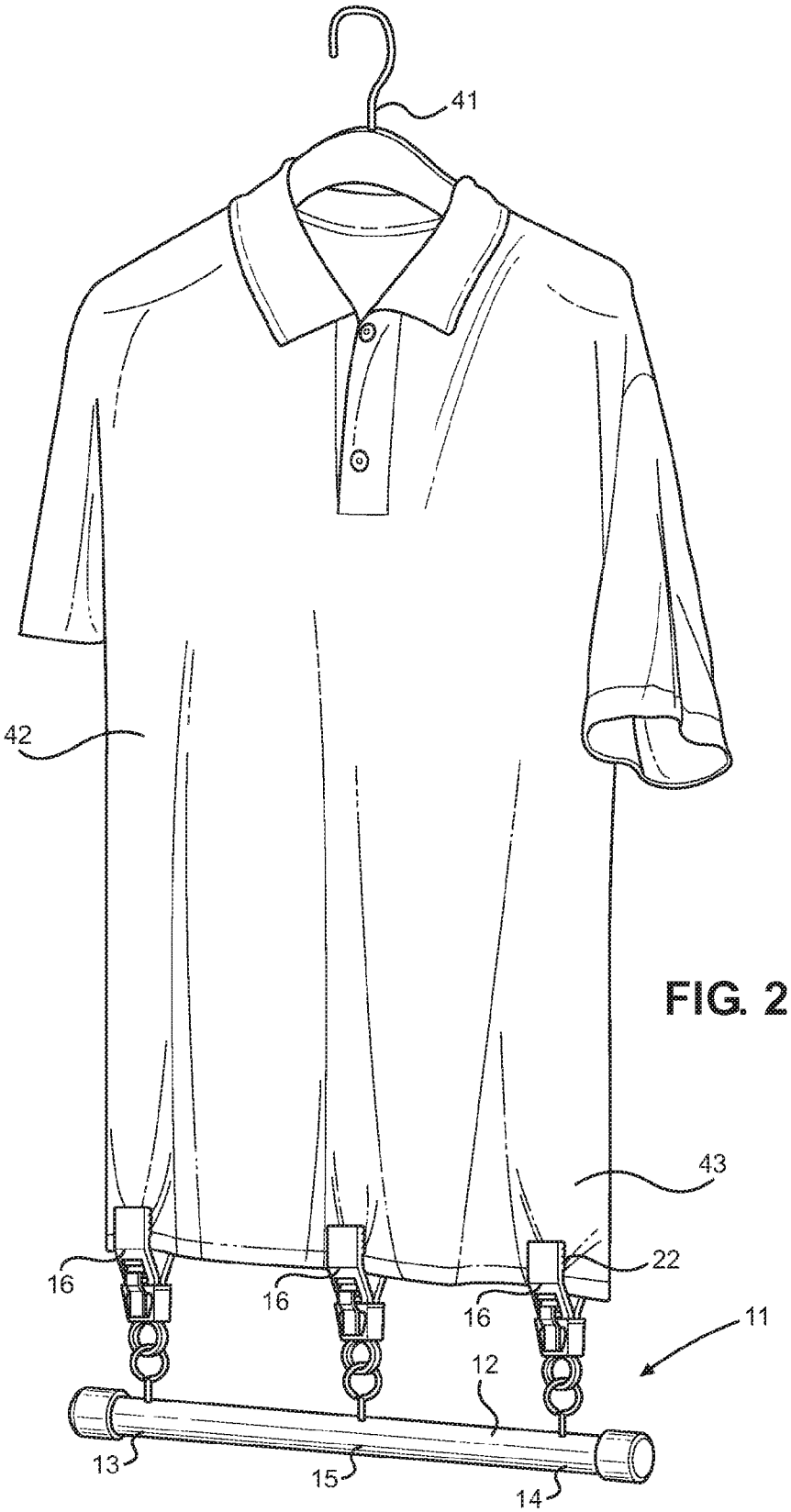
FIG. 2 shows a perspective view of a garment stretcher according to the present invention in use.

Referring now to FIG. 2, there is shown a perspective view of a garment stretcher according to the present invention in use. As shown, the garment stretcher 11 is secured to a lower end 43 of a shirt 42 that is hung on a clothes hanger 41. While a shirt is shown, the garment stretcher 11 may be secured to any type of garment that may be elongated via continuous weight applied thereto. The ridges 22 of the clips 16 engage the fabric of the shirt 42 in order to secure the elongated weight 12 thereto. Since the clips 16 are disposed equidistant from one another on the first end 13, second end 14, and midpoint 15, the weight of the elongated weight 12 is evenly distributed across the lower end 43 of the shirt 42. The evenly distributed weight causes the shirt 42 to stretch and lengthen overtime in a uniform manner, such that the shirt 42 maintains its original shape other than the elongation of the lower portion 43. Once the shirt 42 is the desired length, a user may remove the garment stretcher 11 from the shirt 42 by unlocking and disconnecting the clips 16 therefrom.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garment stretcher, comprising:

an elongated weight comprising a first end, a second end, and a midpoint, wherein the midpoint is equidistant from the first end and the second end;

a first eyelet disposed on the first end of the elongated weight;

a second eyelet disposed on the second end of the elongated weight;

a third eyelet disposed on the midpoint of the elongated weight;

a first clip, a second clip, and a third clip, each comprising an upper end having a pair of jaws thereon and a lower end having a loop thereon;

the loop of the first clip connected to the first eyelet;

the loop of the second clip connected to the second eyelet;

the loop of the third clip connected to the third eyelet;

wherein the pair of jaws of the first clip, second clip, and third clip are adapted to tighten against a piece of fabric in order to removably secure the elongated weight thereto.

2. The garment stretcher of claim 1, wherein the loop of the first hook is freely rotatable about the first eyelet, the loop of the second hook is freely rotatable about the second eyelet, and the loop of the third hook is freely rotatable about the third eyelet.

3. The garment stretcher of claim 1, wherein the first eyelet comprises a first opening, the second eyelet comprises a second opening, and the third eyelet comprises a third opening, wherein the first eyelet, second eyelet, and third eyelet are oriented such that the first opening, second opening, and third opening are aligned with one another.

4. The garment stretcher of claim 1, wherein the first clip, second clip and third clip are removably secured to the elongated weight.

5. The garment stretcher of claim 1, wherein the elongated weight is composed of metal.

6. The garment stretcher of claim 1, wherein the elongated weight is composed of rubber.

7. The garment stretcher of claim 1, further comprising a first end cap disposed on the first end of the elongated weight and a second end cap disposed on the second end of the elongated weight.

8. The garment stretcher of claim 7, wherein the first end cap is removably secured to first end of the elongated weight, and wherein the second end cap is removably secured to the second end of the elongated weight.

* * * * *